US009543692B2

(12) United States Patent
Shomali

(10) Patent No.: US 9,543,692 B2
(45) Date of Patent: Jan. 10, 2017

(54) RELOCATABLE POWER TAP FOR USE IN A PATIENT CARE AREA

(71) Applicant: American IV, Inc., Harmans, MD (US)

(72) Inventor: Majdi Shomali, Arlington, VA (US)

(73) Assignee: American IV, Inc., Harmans, MD (US)

( * ) Notice: Subject to any disclaimer, the term of this patent is extended or adjusted under 35 U.S.C. 154(b) by 0 days.

(21) Appl. No.: 14/066,044

(22) Filed: Oct. 29, 2013

(65) Prior Publication Data

US 2015/0118896 A1 Apr. 30, 2015

(51) Int. Cl.
*H01R 25/00* (2006.01)
*H01R 13/52* (2006.01)

(52) U.S. Cl.
CPC ..... *H01R 13/5224* (2013.01); *H01R 25/003* (2013.01); *H01R 13/5213* (2013.01)

(58) Field of Classification Search
CPC ..... H01R 13/74; H01R 25/006; H01R 24/76; H01R 13/6395; H01R 25/003; H01R 25/00; H01R 13/514; H01R 13/73
USPC ..... 439/535–536, 652, 654, 574
See application file for complete search history.

(56) References Cited

U.S. PATENT DOCUMENTS

| | | | | | |
|---|---|---|---|---|---|
| D325,723 | S | * | 4/1992 | Gary et al. | D13/139.4 |
| 5,351,173 | A | * | 9/1994 | Byrne | 362/127 |
| 5,906,517 | A | * | 5/1999 | Crane et al. | 439/654 |
| 6,004,157 | A | * | 12/1999 | Glass | 439/574 |
| 6,042,426 | A | * | 3/2000 | Byrne | 439/654 |
| 6,379,182 | B1 | * | 4/2002 | Byrne | 439/574 |
| 6,593,528 | B2 | * | 7/2003 | Franklin-Lees et al. | 174/58 |
| 6,968,955 | B2 | * | 11/2005 | Steeber | 206/702 |
| D638,360 | S | * | 5/2011 | Kan | D13/139.4 |

* cited by examiner

*Primary Examiner* — Xuong Chung Trans
(74) *Attorney, Agent, or Firm* — Garrett IP, LLC

(57) ABSTRACT

A power tap configured to deflect falling material, such as liquid and/or object, from electrical outlets. The power tap includes a housing having an opening to an electrical outlet, and a shelf that extends outwardly from a portion of the housing above the opening when the housing is in an upright position to divert or deflect falling matter away from the electrical outlet. The power tap may be configured as a relocatable power tap, and may be configured for use in a patient care area in compliance with one or more standards for safety and effectiveness of medical electrical equipment.

8 Claims, 9 Drawing Sheets

RELOCATABLE POWER TAP FOR USE IN A PATIENT CARE AREA

TECHNICAL FIELD

Protection of electrical outlets from falling material, such as liquid and/or objects, including relocatable power taps for use in patient care areas.

BACKGROUND

Electrical outlets and electrical plugs are susceptible to falling material such as liquid and/or objects. For example, where male terminals or pins of an electrical plug are not fully inserted into an electrical outlet, an electrically conductive object may contact the exposed male terminals. This may create a spark, provide a current path (i.e., a short circuit) between the terminals, and/or trip a circuit breaker. Similar dangers exist in the case falling liquid, even where the male terminals are fully inserted into the electrical plug.

Technical standards for safety and effectiveness of medical electrical equipment have been promulgated by a number of organizations. For example, IEC 60601 is a series of technical standards maintained by the International Electrotechnical Commission, and first published in 1977. As of 2011, IEC 60601 includes a general standard IEC 60601-1, approximately 10 collateral standards, and approximately 60 particular standards. National versions of IEC 60601 include UL 60601, Edition 1, published Apr. 25, 2003, by Underwriters Laboratory.

UL standard 1363A, Edition 3, published May 2, 2007, is directed to special purpose relocatable power taps (SPRPT), for use with medical equipment in patient care areas to supply power to plug-connected components of a movable equipment assemblies, such as rack-mounted, table-mounted, and pedestal-mounted mounted equipment.

Many companies view compliance with such standards as a pre-requisite for commercialization of electrical medical equipment.

SUMMARY

Disclosed herein are methods and systems to protect electrical outlets from falling material, such as liquid and/or object, from electrical outlets.

A power tap as disclosed herein may include a housing to hold an electrical outlet, and a shelf that extends outwardly from a portion of the housing that is above the electrical outlet when the housing is in an upright position to divert or deflect falling matter away from the electrical outlet.

The power tap may be configured as a relocatable power tap, and may be configured for use in a patient care area in compliance with one or more standards identified further above.

The relocatable power tap may be removably mountable to a pole, such as a wheel-mounted patient care or IV pole.

Figure 1:
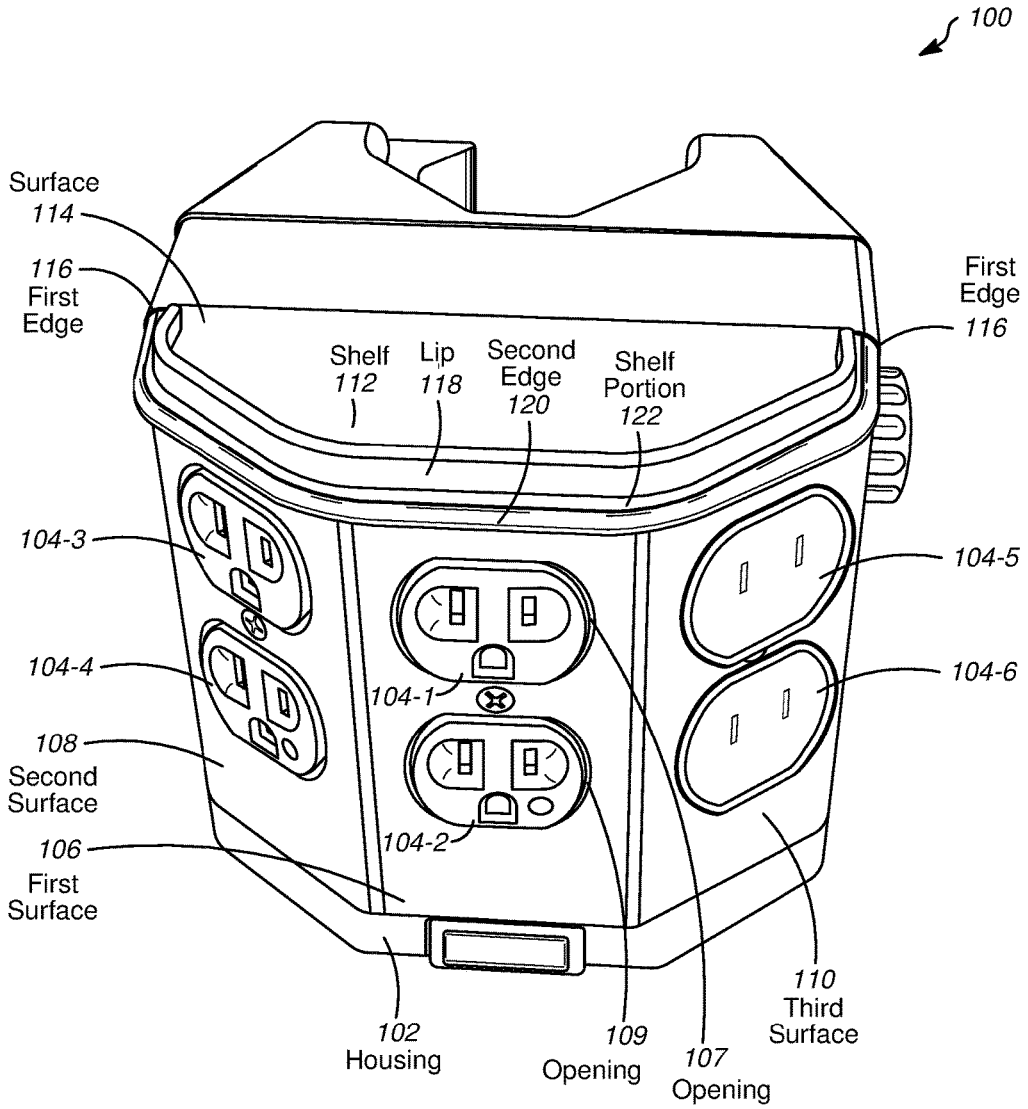
FIG. 1 is an image of a relocatable power tap that includes a housing to hold one or more electrical outlets, and a shelf that extends from the housing to deflect falling objects from the electrical outlet(s), where the housing is illustrated in an upright position.

In the drawings, the leftmost digit(s) of a reference number identifies the drawing in which the reference number first appears.

DETAILED DESCRIPTION

FIG. 1 is an image of a relocatable power tap 100. Methods and systems disclosed herein are not, however, limited to re-locatable power taps and may be implemented as a stationary or fixedly mounted power tap.

Power tap 100 includes a housing 102 having a cavity therein to receive to receive an electrical outlet 104-1. Housing 102 further has an opening 107 to the cavity through a first surface 106 to permit electrical outlet 104-1 to receive an electrical plug. First surface 106 is vertical when housing 102 in the upright position of FIG. 1.

In the example of FIG. 1, power tap 100 includes multiple electrical outlets, illustrated here as a first pair of electrical outlets 104-1 and 104-2, a second pair of electrical outlets 104-3 and 104-4, and a third pair of electrical outlets 104-5 and 104-6. In this example, housing 102 may include a single cavity to hold the three pairs of electrical outlets, or multiple cavities, each to hold one or more electrical outlets. Methods and systems disclosed herein are not, however, limited to a power tap having multiple electrical outlets.

In this example, housing 102 may include a second opening 109 through a first surface 106 to permit electrical outlet 104-2 to receive an electrical plug, and additional openings through second and third surfaces 108 and 110 to permit electrical outlets 104-3 through 104-6 to receive electrical plugs.

Second and third surfaces 108 and 110 are vertical when housing 102 is in an upright position, as illustrated in FIG. 1.

In the example of FIG. 1, first, second, and third surfaces 106, 108, and 110 are in planes that are not parallel with one another.

Power tap 100 further includes a shelf 112 that extends from housing 102. When housing 102 is in the upright position of FIG. 1, shelf 112 extends above or over the openings in surfaces 106, 108, and 110 to intercept or divert falling matter (e.g., liquid and/or objects), to reduce and/or eliminate the possibility of the matter contacting exposed terminals of an electrical plug and/or entering an electrical outlet 104.

Shelf 112 may extend from housing 102 for a distance of at least a portion of a length of electrically conductive prongs of an electrical plug, such as to divert falling matter from contacting the electrically conductive prongs when the electrically conductive prongs are not fully inserted into one of electrical outlets 104. Shelf 112 may extend from housing 102 for a distance of at least a length of the electrically conductive prongs.

A surface 114 of shelf 112 may be horizontal and may face upwardly when housing 102 is in the upright position.

A first edge 116 of shelf 112 may be in contact with housing 102.

Power tap 100 may further include a lip 118 that extends from shelf 112. Lip 118 may extend upwardly from shelf 112 when housing 102 is in the upright position. Lip 118 may be perpendicularly to surface 114 of shelf 112.

Lip 118 may be configured as a dam to prevent liquid from spilling over a second edge 120 of shelf 112 when housing 102 is in the upright position.

First and second ends of lip 118 may extend to first edge 116 of shelf 112 and/or to housing 102.

In the example of FIG. 1, a portion 122 of shelf 112 extends beyond lip 118. In another embodiment, at least a portion of lip 118 may extends from second edge 120 of shelf 112.

In the example of FIG. 1, a height of lip 118 (measured from surface 114 of shelf 112), is tapered from a first height (proximate to first surface 106), to a lower second height at first and second ends of lip 118 (near first edge 116 of shelf 112).

Housing 102 and shelf 112 may be in fixed positions relative to the housing (e.g., non-movable relative to one another).

Shelf 112 and at least a portion of housing 102 may be manufactured as an integral component, such as by injection molding. Housing 102 may, for example, include a cover plate that includes first, second, and third surfaces 106, 108, and 110. In this example, the cover plate and shelf 112 may be manufactured as an integral or single component.

Figure 2:
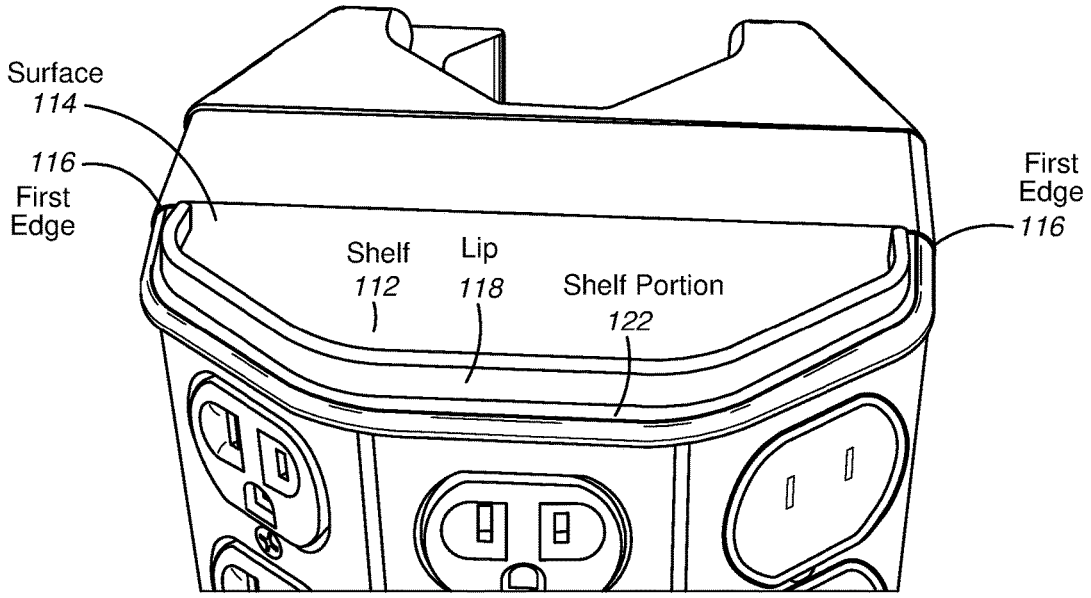
FIG. 2 is an image of an expanded view of the shelf of FIG. 1.

FIG. 2 is an image of an expanded view of shelf 112 with housing 102 in the upright position.

Figure 3:
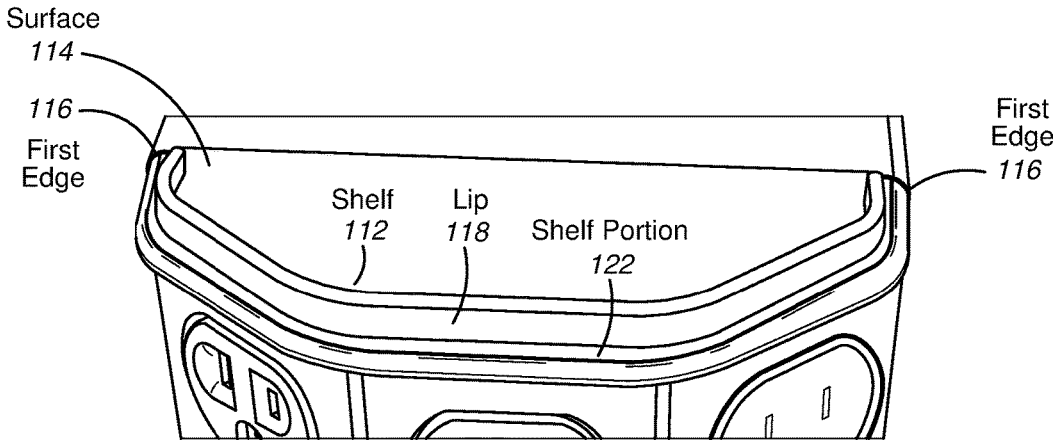
FIG. 3 is an image of a further expanded view of the shelf of FIG. 1.

FIG. 3 is an image of a further expanded view of shelf 112 with housing 102 in the upright position.

Figure 4:
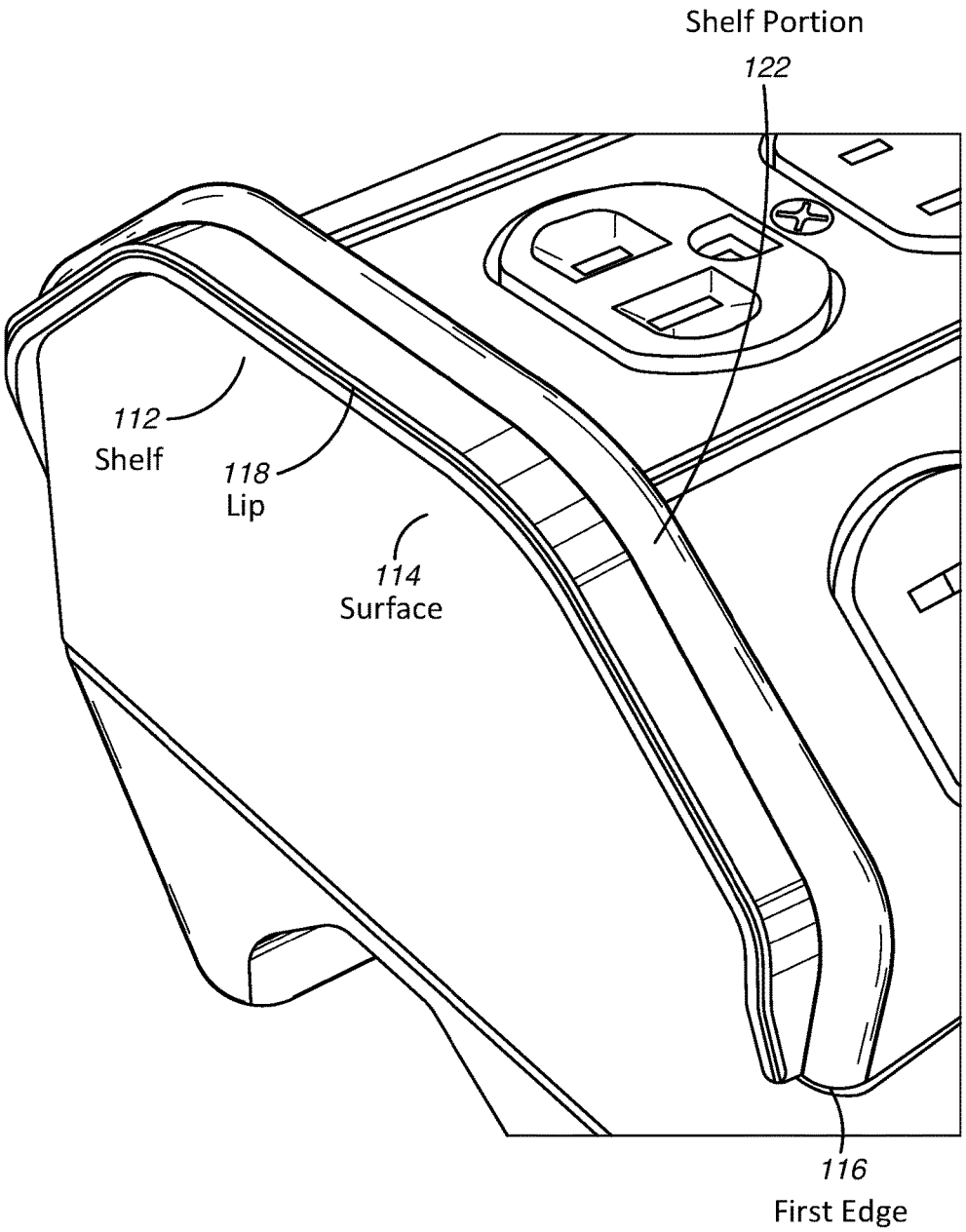
FIG. 4 is an image of another expanded view of the shelf of FIG. 1, where the housing in a non-upright position.

FIG. 4 is an image of another expanded view of shelf 112 with housing 102 in a non-upright position.

Figure 5:
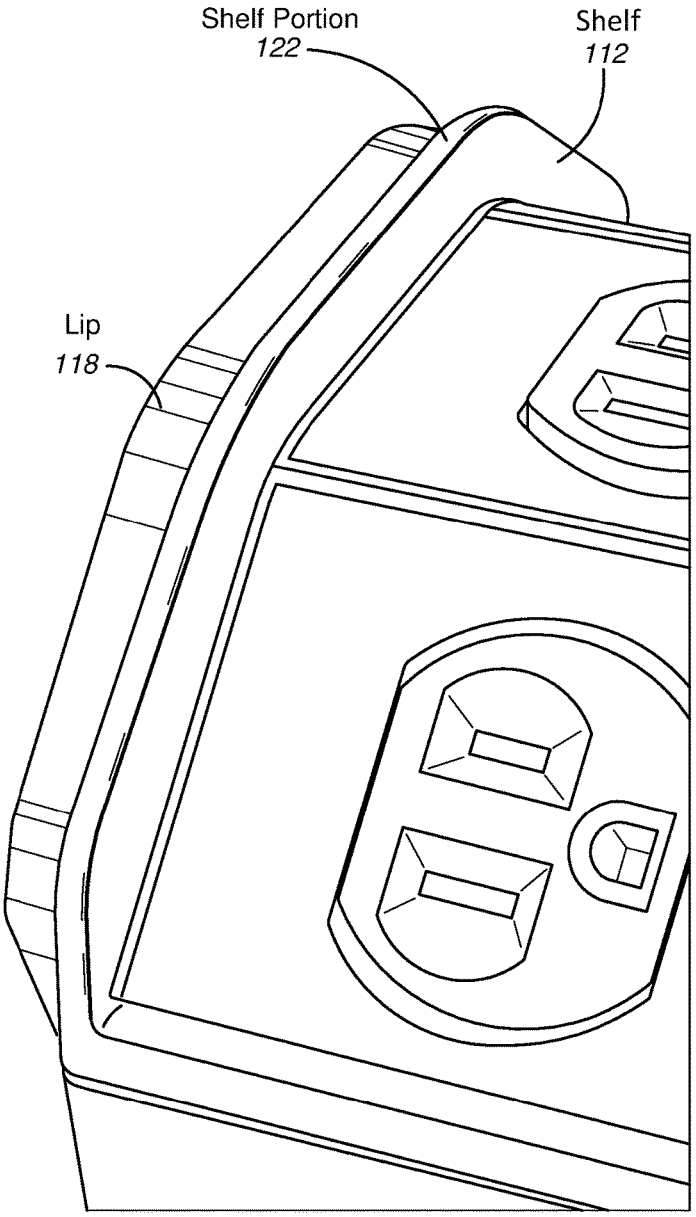
FIG. 5 is an image of another expanded view of the shelf of FIG. 1, where the housing in the non-upright position.

FIG. 5 is an image of another expanded view of shelf 112 with housing 102 in the non-upright position.

Power tap 100 may be removably mountable to a pole, such as described below with reference to FIGS. 6-9.

Figure 6:
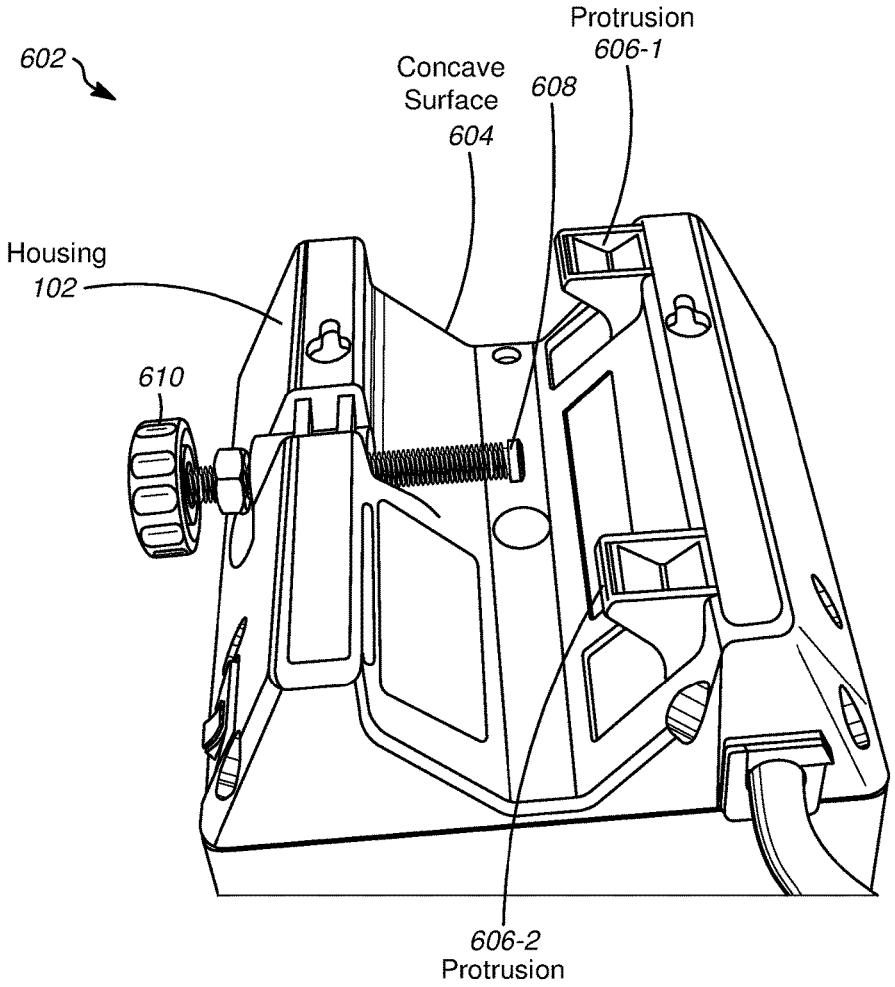
FIG. 6 is an image of a rear portion of the relocatable power tap, where the housing includes a concave surface and protrusions to receive a pole, and where the power tap further includes a releasable locking device to secure the relocatable power tap to the pole.

FIG. 6 is an image of a rear portion 602 of power tap 100, where housing 102 includes a concave surface 604 and protrusions 606 to receive a pole, and where power tap 100 further includes a releasable locking device to secure power tap 100 to the pole. In the example of FIG. 6, the releasable locking device includes a thumbscrew, including bolt having a surface 608 to press against a surface of a pole positioned within concave surface 604 and protrusions 606, and a handle 610 to screw the bolt through a nut embedded within housing 102. Releasable locking devices are not, however, limited to thumbscrews.

Figure 7:
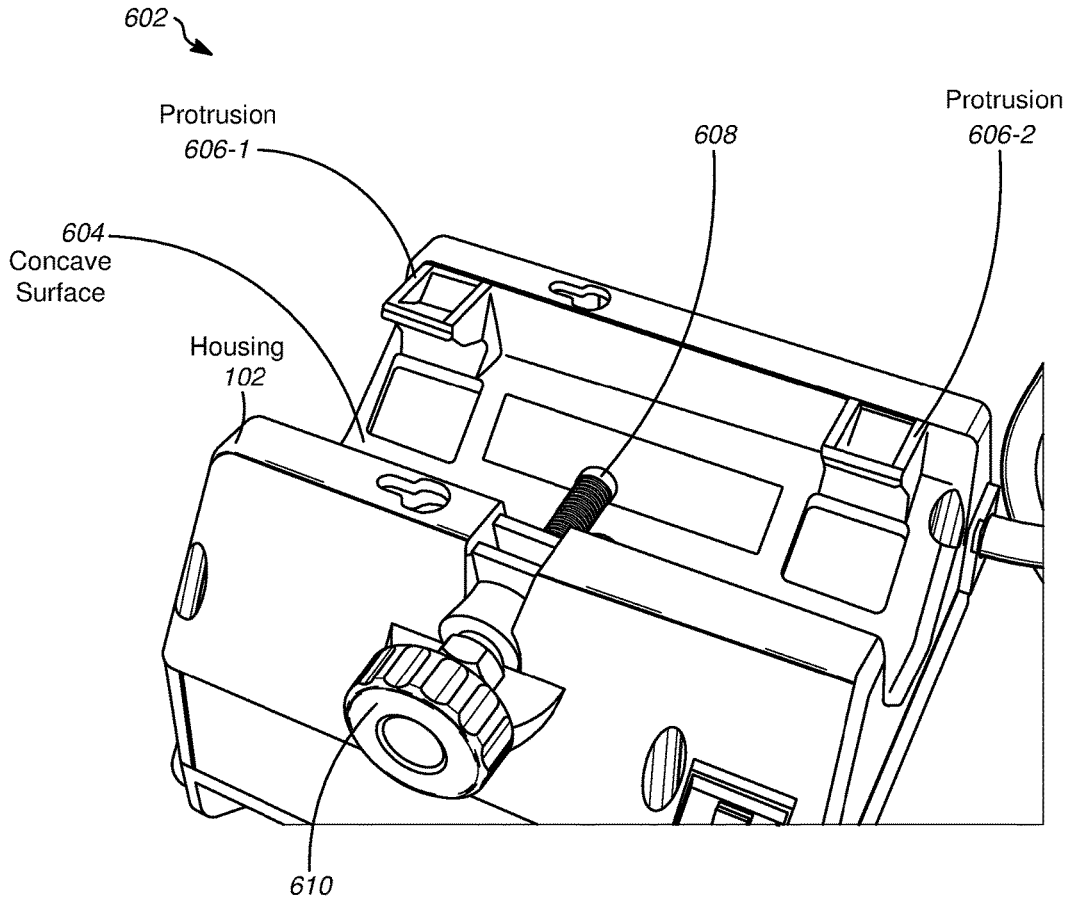
FIG. 7 is another image of the rear portion of the relocatable power tap.

FIG. 7 is another image of a rear portion 602 of power tap 100.

Figure 8:
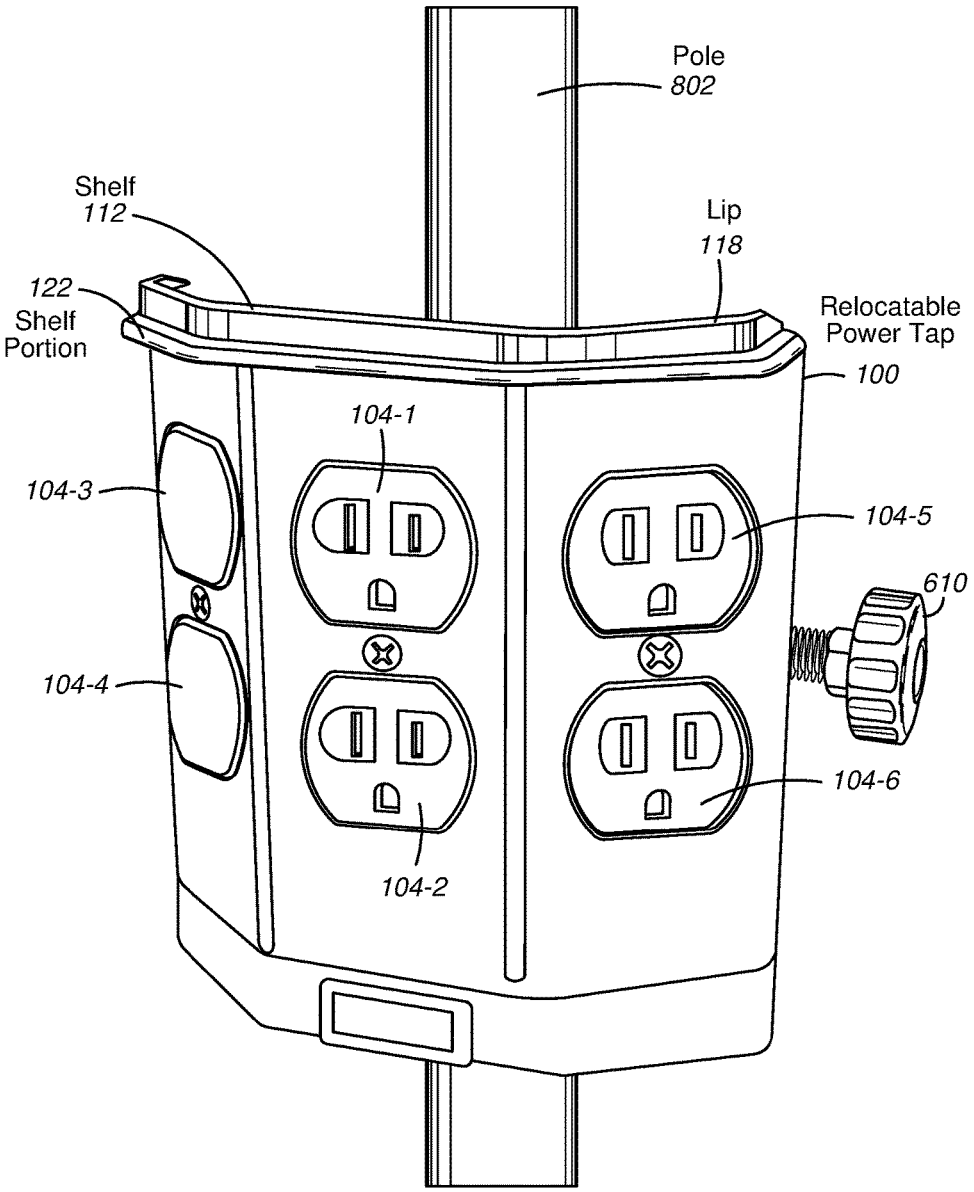
FIG. 8 is an image of the relocatable power tap mounted on a pole.

FIG. 8 is an image of power tap 100 mounted on a pole 802.

Figure 9:
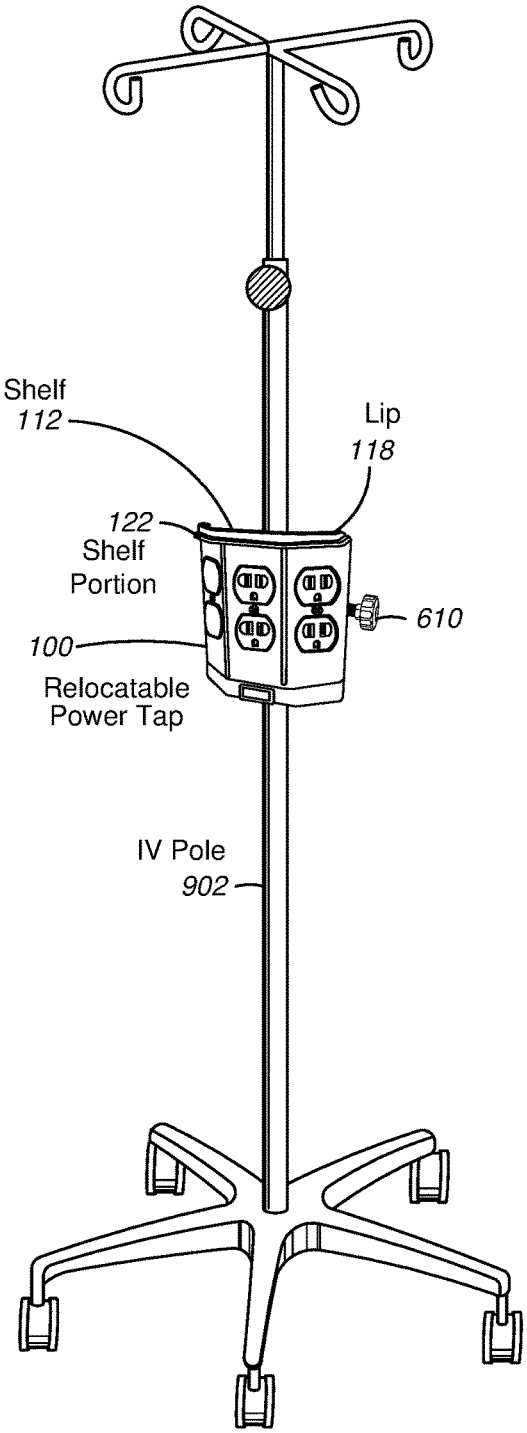
FIG. 9 is an image of the relocatable power tap mounted on a wheel-mounted patient care IV pole.

FIG. 9 is an image of power tap 100 mounted on a wheel-mounted pole 902. Wheel-mounted pole 902 may be configured for use in a patient care area, and may be referred to herein as an IV pole.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What is claimed is:

1. An apparatus, comprising, a housing that includes:

a first upright wall that has an opening through a surface thereof to a cavity within the housing, wherein the opening is dimensioned to expose an electrical receptacle of an electrical outlet positioned within the cavity;

a horizontal wall, wherein a first edge of the horizontal wall is adjacent to an edge of the first upright wall; and a lip that extends away from an exterior surface of the horizontal wall, along the first edge of the horizontal wall, to prevent liquid on the exterior surface of the horizontal from flowing over the first edge towards the first upright wall;

wherein a second edge of the horizontal wall is contoured to permit liquid on the exterior surface of the horizontal wall to flow over the second edge of the horizontal wall away from the first upright wall.

2. The apparatus of claim 1, wherein the first edge of the horizontal wall extends beyond a plane of the first upright wall.

3. The apparatus of claim 1, wherein the lip extends perpendicularly away from the external surface of the horizontal wall.

4. The apparatus of claim 1, wherein the lip has a height that is tapered from a first height at each of first and second ends of the lip, to a second height between the first and second ends of the lip.

5. The apparatus of claim 1, wherein:

the housing further includes one or more additional upright walls, each having a corresponding opening through a surface thereof to the cavity;

the first edge of the horizontal wall is adjacent to an edge of each of the one or more additional upright walls;

the lip is configured to prevent liquid on the exterior surface of the horizontal wall from flowing over the first edge of the horizontal wall towards the first upright wall and the one or more additional upright walls; and the second edge of the horizontal wall is configured to permit liquid on the exterior surface of the horizontal wall to flow over the second edge of the horizontal wall away from the first upright wall and the one or more additional upright walls.

6. The apparatus of claim 5, wherein planes of the first upright wall and the one or more additional upright walls are not parallel with one another.

7. The apparatus of claim 1, wherein the housing is removably mountable to a wheel-mounted pole.

8. The apparatus of claim 7, wherein the housing includes a concave surface and protrusions to receive the pole, and wherein the apparatus further including a releasable locking mechanism to secure the housing to the pole.

* * * * *